United States Patent [19]

Bertolazzi

[11] Patent Number: 4,477,103

[45] Date of Patent: Oct. 16, 1984

[54] CONTINUOUS FORM FOR PRINTER

[75] Inventor: Ugo Bertolazzi, Corsico, Italy

[73] Assignee: Honeywell Information Systems Inc., Waltham, Mass.

[21] Appl. No.: 375,170

[22] Filed: May 5, 1982

[30] Foreign Application Priority Data

May 7, 1981 [IT] Italy ..... 21537 A/81

[51] Int. Cl.[3] ..... B42D 15/00

[52] U.S. Cl. ..... 283/62; 282/11.5 A; 281/2; 281/5

[58] Field of Search ..... 283/62; 282/11.5 R, 282/11.5 A, 12 A, 12 B, 22 R, 25 R, 27 R, 28 A, 28 R, 24 R, 1 A, 2, 9 R; 281/2, 5

[56] References Cited

U.S. PATENT DOCUMENTS

| | | | |
|---|---|---|---|
| 333,183 | 12/1885 | Wheeler | 281/5 |
| 2,023,357 | 12/1935 | Harvey | 281/5 |
| 2,532,664 | 12/1950 | Freedman | 281/5 |
| 3,951,252 | 4/1976 | Selke et al. | 83/482 X |
| 4,300,790 | 11/1981 | Griffin | 282/9 R |

*Primary Examiner*—Paul A. Bell

*Attorney, Agent, or Firm*—William A. Linnell; Nicholas Prasinos

[57] ABSTRACT

A continuous form for a printer, suitable for office automation, consists of: (A) a plurality of contiguous sheets identified by reference marks regularly spaced along the form length having sheets of a first type with a preprinted heading being followed at a preestablished frequency in the form by sheets of a second type, without such preprinted heading, so that, when used in a printer provided with a cutter, by printing on selected sheets of the form and by cutting the printed sheets from the form and by collecting the printed sheets, letters, circulars and similar paper on several sheets of equal size and different type can be automatically obtained, or (B) in an alternative embodiment, a plurality of identical contiguous sheets each comprising a preprinted head zone and a tail zone, both zones having the same height, the length of the sheets exceeding a desired final sheet length by the height of the tail zone, so that letters, circulars and similar papers on several sheets of equal size and different types can be obtained by selectively cutting out from the form sheets including either the head zone or the tail zone.

2 Claims, 2 Drawing Figures

CONTINUOUS FORM FOR PRINTER

FIELD OF THE INVENTION

The present invention relates to a continuous form for printers and, more particularly, to a continuous form suitable for the office automation applications.

DESCRIPTION OF THE PRIOR ART

It is known that, with the introduction of data processing systems which, have been more and more reduced in sizes, and less and less expensive, the automated processing of documents has spread and more and more widely. An aspect of the office automation is the so-called "word processing". In "word processing" systems, letters, reports and papers to be printed are entered and stored, through a data entry keyboard, into a data processing system which then provides for "editing" them or printing them by means of high speed printers. The information stored in the system may be corrected, integratd with other information and paged with suitable criteria. In order to perform these operations, it is not necessary to retype (re-enter) the whole text, but it suffices to give to the system, through the keyboard, suitable commands for correction and "editing".

In this automated process of document preparation, a critical point is the automated handling of the printing forms, that is of the paper on which the printing is to be done. The most common and inexpensive printers solve this problem in simple and functional ways by using continuous printing forms which either have or don't have side perforations and may be either folded or rolled. The feeding devices for the continuous form are very simple, but the operator has to manually cut the continuous form in order to obtain the individual sheets of the paper. This manual separation operation is generally executed by tearing the continuous form along a suitable tear straight edge. The resulting cut quality is very poor and incompatible with the preparation of quality documents, as for instance official letters, circulars, etc. In order to satisfy this last requirement, it is necessary to resort to discrete sheets with a predefined size which are manually inserted into the printers of the system. Such a manual operation involves a considerable waste of time. There is equipment on the market for automatic insertion of discrete sheets into printers, but such equipment is very expensive, in practice it is more expensive than the whole "word processing" system and related printer especially if the sheet feeding equipment is able to draw from several stored printing sheets of different types (for example, headed sheets for the first page of a letter and blank sheets for the following pages).

Recently some printers which provide an automatic cutting device have been put on the market. Such printers allow the automatic cutting of the continuous form into discrete sheets, once such sheets have been printed and, at the same time, solve the problems of the quality of cutting speed by means of simple and inexpensive devices. An example of the above mentioned printers is described in U.S. Pat. No. 3,951,252 issued Apr. 20, 1976. However, such printers do not solve the problem of the preparation of sheets which must have different characteristics. For instance, if the continuous printing form is blank, it will be up to the printer to provided, through a printing operation, the heading required for the first page of letters. Alternatively, if the continuous printing form is preprinted with the required heading, all the sheets obtained through a cutting operation will contain the preprinted heading.

SUMMARY OF THE INVENTION

The present invention obviates these disadvantages and provides a continuous printing form from which it is possible to obtain, after the printing operations and through automatic cutting by the printer, both preprinted sheets (that is first pages) and sheets without headings or with different headings (e.g., paper sheets following the first page).

According to a first aspect of the invention, this is obtained by using a continuous preprinted form ideally constituted by a plurality of sheets which have standardized length and alternately are headed and blank. The printers present on the market are therefore able to position, by means of related feeding devices, the continuous form in such a way as to print the form portions corresponding to headed pages or the form portions corresponding to blank pages depending on the need. In printers, a continuous printing form can be fed in only one direction and, once a sheet has been cut, it is not possible to use the same sheet again. Therefore, the present invention will generally involve some paper waste but this is compensated for by the automation advantages obtainable with reduced investment costs. The paper waste may be reduced by selecting a suitable alternance among successive sheets. For instance, if the "word processing" system will be mostly used to prepare letters containing a first headed page and two successive non-headed sheets, the ideal continuous form will contain a headed sheet followed by two blank sheets.

According to a further aspect of the invention, the paper waste is minimized by means of a different artifice. In fact, the printing form is ideally comprised of all headed sheets successively arranged one after the other, but the length of such sheets is larger than the length of a standard sheet by an extra length equal to the space occupied by the heading. In this case, a blank space of length at least equal to the standard sheet length exists downstream the heading. It is therefore clear that, depending on the position in which cutting of the continuous printing form is performed, both headed sheets and blank sheets can be obtained with a reduced paper waste having a length equal to the length of the heading.

These and other features of the invention will appear more clearly from the following description and from the enclosed drawings where:

BRIEF DESCRIPTION OF THE DRAWINGS

The manner in which the method of the present invention is performed and the manner in which the apparatus of the present invention is constructed and its mode of operation can best be understood in light of the following detailed description together with the accompanying drawings in which like reference numbers identify like elements in the several figures and in which.

DESCRIPTION OF THE PREFERRED EMBODIMENT

Figure 1:
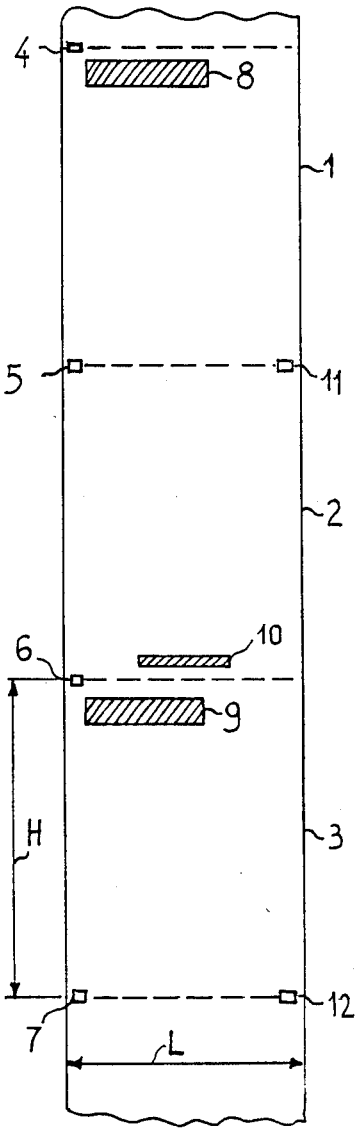
FIG. 1 shows a first embodiment of continuous printing form according to the invention.

Referring to FIG. 1, the continuous form consists in a continuous paper strip and is ideally subdivided in a plurality of successive sheets 1, 2, 3 of height H and length L. The sizes of each sheet may be arbitrarily chosen according to the needs, even if they preferably correspond to standard values. For example, in Europe the standard size for correspondence sheets is 21×29, 7 mm. In the U.S.A., the standard size is 8.5×11 inches (equal to 21.6×27, 9 mm.). The beginning of each sheet is defined by a perforation or by a printed reference mark, like 4, 5, 6, 7, preferably arranged next to one of the form edges. It is clear that each perforation or reference mark defines both the beginning of one sheet and the end of the previous sheet. On the top of the sheets identified in FIG. 1 by an odd reference number (1 and 3) a suitable heading is preprinted. These headings are sketched by hatched areas 8, 9 and may, for instance, comprise the name of the trademark of a firm, its address and phone number and so on. The sheets identified by an even reference number (2) are, on the contrary, blank or may contain a preprinted inscription arranged next to the bottom and shown by outlines area 10 inside sheet 2. Such inscription may repeat the film address and name with a format generally smaller than the one used in the odd sheets, defined as first sheets below. A continuous form of the above described type may be suitably used in the high speed printers of data processing systems or in the so-called "word processing" systems. As known, such printers are provided with detecting means which allow them to detect the presence of perforations or marks, as the ones numbers by 4, 5, 6, 7 in FIG. 1, and with feeding means which allow the printers to feed the continuous printing form so as to position exactly in vertical direction the several sheets constituting the form and relative to the printing line, so as to provide printing in a desired position on each of the forms. The form positioning may be performed both automatically owing to a program and semiautomatically on operator command supplied through a keyboard. Some of such printers, as for instance the one described in the mentioned patent, are also provided with a cutter in order to cut automatically the continuous form thus obtained discrete sheets. The cuts are made along horizontal lines at a prefixed vertical distance from the horizontal lines identified by the marks of the several sheets.

In the described example, for simplicity and clearness purposes, the cuts are supposed to be made along the horizontal lines identified by the marks, that is, the vertical distance between the cutting line and the horizontal line identified by the related mark is supposed to be zero.

Referring to the automated preparation of printed papers, in particular correspondence letters, the use of a form of the above described type is clear. If a first page has to be printed, it suffices to command one or more advancements of the continuous form until the beginning of first sheet, for instance sheet 1 in FIG. 1 is brought in coincidence with the cutting line of the printer. The printer provides, automatically or upon command, to cut the form next to mark 4 and afterwards prints the text on sheet 1. Once printed, the continuous form is automatically fed up to the beginning of the subsequent sheet (sheet 2), that is next mark 5 is brought in coincidence with the cutting line, then the printed sheet (sheet 1) is cut. If the text to be printed is complete and a new text has to be printed on a new first sheet, the operator can command a semiautomatic feed of the form so as to position it to the beginning of first sheet 3.

Sheet 2 will not be printed and will be automatically cut away from the form and manually removed by the operator. If, on the contrary, the text to be printed is not complete and has to be completed on a sheet without heading, that is on a second sheet like sheet 2, the printing will be performed on such sheet. It is therefore clear that the described continuous form eliminates the need for the operator to manually insert into the printer sheets of a different type, as well as, in alternative, the need to use automated devices for inserting sheets of a different type. It is further clear that the paging of a text on several sheets of a different type may be automatically performed by program, without any intervention from the operator, if the reference marks identifying the beginning of each sheet are such as to allow the printer to recognize automatically the sheet types. This may be obtained by using marks or different shapes and sizes for the several types (in such case, the printer has to be provided with detecting means able to distinguish different shapes and sizes among them) or marks arranged in different horizontal positions according to the sheet types (for instance, the beginning marks of the first sheets may be arranged next to the left edge of the form and the beginning marks of the second sheets next to the right edge of the form, as shown for marks 11, 12 of FIG. 1. In such case, the printer has to be provided with several detecting means).

The described continuous form may be optimized in relation to its several uses. For instance, if the use of an only first sheet is generally sufficient for the particular office needs and the use of a second sheet is seldom required, the continuous form may be prearranged in such a way as to contain groups of two or more consecutive first sheets spaced by a second sheet. In the opposite circumstance, the continuous form may contain groups of two or more consecutive second sheets spaced by a first sheet. Of course these optimizations are prejudicial to a generalized use of the continuous form.

Figure 2:
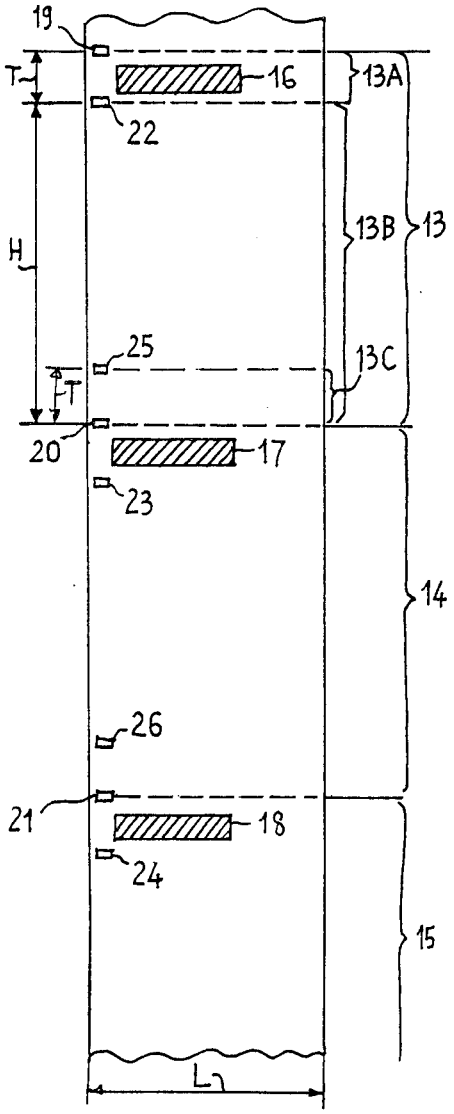
FIG. 2 shows a second embodiment of continuous printing form according to the invention.

FIG. 2 shows an embodiment of continuous form capable of generalized use and reducing to a minimum the paper waste. In FIG. 2 the continuous form is ideally constituted by a plurality of successive sheets 13, 14, 15 of height H+T and width L. Each sheet is ideally constituted by a header (like 13A) of height T and by a page (like 13B) of height H. The sizes L and H may be arbitrarily chosen according to the needs, but they preferably correspond to standard page sizes. The height T of each header is preferably reduced to a minimum sufficient for containing a preprinted heading shown by hatched areas 16, 17, 18. The beginning of each sheet is defined by a perforation or preprinted reference mark like 19, 20, 21 preferably arranged next to one of the form edges. The end of each header is likewise defined by a perforation or preprinted reference mark like 22, 23, 24. The bottom of each sheet like 13B comprises a tail 13C of height T. The beginning of each tail is defined by a perforation or preprinted reference mark like 25, 26. The use of such type of continuous form in a printer, provided with a cutter and with detecting means able to recognize the form position, is clear. When the printing has to be made on a standard sheet provided with heading (first sheet), the form is positioned by using as reference marks for sheet beginning and end the marks like 19, 20, 21 and 25, 26 respectively. The continuous form is therefore cut next to such marks. When the printing has to be made on a standard sheet without heading (second sheet), the form is positioned by using as reference marks for sheet beginning and end the marks like 22, 23, 24 and 20, 21 respectively. The continuous form is therefore cut next to such marks. As in the case of FIG. 1, the recognition of these marks may occur by using marks with different shape or horizontal position. It is to be noted that the commonly used printers are able to feed accurately the continuous form with a prefixed number of steps without requiring a control feed-back as the one provided by signals generated by detecting means associated with the form marks. Thus, the reference marks provided to indicate the end of a head or of a sheet are not essential and the recognition marks provided on the continuous form can be reduced to the ones specifying the beginning of each sheet above the header and the ones specifying the end of each header. By using the type of continuous form of FIG. 2, the paper waste whenever a sheet is printed, consists in either the waste of a header or the waste of a tail, that is practically no more than 20% of the used material.

While the invention has been shown and described with reference to the preferred embodiment thereof, it will be understood by those skilled in the art that the above and other changes in form and detail may be made therein without departing from the spirit and scope of the invention.

What is claimed is:

1. A continuous form for printers suitable for office automation applications, said form comprising: pre-established sheet reference marks regularly spaced along the length of said form, said marks identifying in said form a sequence of contiguous sheets, some and not all of said sheets being preprinted according to pre-established sequence criteria with a heading so that said form is constituted by a series of sheets having equal lengths, wherein first sheets with said heading follow periodically, with pre-established frequency, second sheets of a second type without said preprinted heading.

2. A continuous form for printers as in claim 1 wherein said sheet reference marks further comprise marks of a first type to identify said first sheets and marks of a second type to identify said second sheets.

* * * * *